United States Patent [19]

Sipple

[11] Patent Number: 4,872,582

[45] Date of Patent: Oct. 10, 1989

[54] WEIGHTED REFUSE CONTAINER

[76] Inventor: Gene L. Sipple, 3207 N. Rankin St., Appleton, Wis. 54911

[21] Appl. No.: 196,053

[22] Filed: May 19, 1988

[51] Int. Cl.[4] ..... B65D 90/00

[52] U.S. Cl. ..... 220/1 T; 220/68

[58] Field of Search ..... 220/1 T, 68, 87, 215

[56] References Cited

U.S. PATENT DOCUMENTS

| | | | |
|---|---|---|---|
| 1,234,992 | 7/1917 | Winters | 220/87 |
| 1,380,149 | 3/1920 | Kappel | 220/68 |
| 1,409,387 | 9/1920 | Madigan | 220/87 |
| 2,394,319 | 2/1945 | McDonald | 220/68 |
| 2,936,926 | 6/1958 | Miller | 220/68 |
| 3,102,661 | 8/1960 | Londquist | 220/87 |
| 3,170,589 | 12/1962 | Winslow | 220/68 |
| 3,394,832 | 7/1968 | McAllister | 220/1 T |
| 4,711,296 | 12/1987 | Nonlist | 220/68 |

FOREIGN PATENT DOCUMENTS

| | | | |
|---|---|---|---|
| 682576 | 10/1960 | Italy | 220/68 |

*Primary Examiner*—Stephen Marcus
*Assistant Examiner*—Gilbert W. Reece
*Attorney, Agent, or Firm*—Leon Gilden

[57] ABSTRACT

A weighted refuse container is set forth formed with a compartment formed within a false floor of the container. The compartment has threadedly formed thereto a removable container plug to enable the compartment to receive a quantity of fluid to counterweight and bias the container against tippage. Similarly, the lid of the container is formed with a removable compartment plug to receive a reduced quantity of fluid to minimize loss of the lid and container by wind action.

1 Claim, 3 Drawing Sheets

WEIGHTED REFUSE CONTAINER

BACKGROUND OF THE INVENTION

1. Field of the Invention

The present invention relates to refuse containers, and more particularly pertains to a new and improved refuse container which is formed with a weighted floor and lid formed with a weighted compartment to minimize wind loss of the container and lid.

2. Description of the Prior Art

The use of refuse containers is well known in the prior art. As may be appreciated, the conventional containers are formed of relatively light-weight plastic-like materials to enhance transport and longevity of such containers in use. Unfortunately, such containers are subject to wind loss by their light-weight construction and replacement in geographical areas of relatively high wind disturbances is frequent. Prior art devices have set forth a myriad of refuse container constructions to counter various problems in the use of refuse containers, but have tended to ignore the contemporary light-weight containers and the problem of same in areas of high wind activity.

An example of contemporary container construction to deal with particularized problems is set forth in U.S. Pat. No. 8,997,072 to Guth as a refuse container for a particular use in combination with a trash compactor wherein the container is formed with a removable base to enable ease of disassembly therefrom and removal of the container from the trash compactor. The Guth patent is of interest relative to the use of a refuse container in a particular environment, but is of a relatively remote organization to the instant invention.

U.S. Pat. No. 1,351,747 to Flinn sets forth a refuse container nestably received within an outer shell for storage of the container to enhance longevity of the inner container and minimize damage thereto.

U.S. Pat. No. 8,082,901 to Nakagawa sets forth a refusetype container with an inner disposable receiver wherein the inner receiver is formed of a fluid-tight construction to enable reception of fluid therein to extinguish ash and the like in use in cooperation with cigarette smoking.

U.S. Pat. No. 8,451,453 to Heck sets forth a waste receptacle formed with disposable interior liners wherein a lower compartment is formed with a dispensing arrangement to enable withdrawal of liners to utilize in combination with the container. While of interest relative to the solution of a particular problem, the Heck patent is of a structure and organization relatively remote to that of the instant invention.

U.S. Pat. No. 8,856,173 to Deane sets forth a refuse container and receptacle rack wherein a refuse container is positioned within the rack and provided with enhanced stability, wherein the instant invention dispenses with such extraneous structural organization to provide a compact self-contained organization biased against loss of the container by wind action.

U.S. Pat. No. 8,927,786 to Aboud sets forth a container with a detachably removable bottom portion to enable readily removal of trash can liners that may be utilized in combination with the patent where the central portion of the container is formed as a tube securable to without a floor and is thereby removable upwardly from about a container liner used in combination with a container.

As such, it may be appreciated that there is a continuing need for a new and improved weighted refuse container which addresses both the problem of storage, portability, and effectiveness, and in this respect, the present invention substantially fulfills this need.

SUMMARY OF THE INVENTION

In view of the foregoing disadvantages inherent in the known types of refuse containers now present in the prior art, the present invention provides an weighted refuse container which may be compactly transported and stored and may be further easily and efficiently provided with a weighted underlying portion to bias same against wind action. As such, the general purpose of the present invention, which will be described subsequently in greater detail, is to provide a new and improved weighted refuse container which has all the advantages of the prior art refuse containers and none of the disadvantages.

To attain this, the present invention comprises a refuse container formed with tapered wall structure for nested transport of a plurality of such containers and wherein the container is formed With a false bottom and an underlying removable threaded plug for filling of the false bottom with a fluid, such as water, to bias the container against removal by wind action and furthermore providing the lid with a spaced floor and removable plug therein of a diminished capacity than the container to bias the lid against wind action to provide a container and lid resistant to loss by wind.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved weighted refuse container which has all the advantages of the prior art refuse containers and none of the disadvantages.

It is another object of the present invention to provide a new and improved weighted refuse container which may be easily and efficiently manufactured and marketed.

It is a further object of the present invention to provide a new and improved weighted refuse container which is of a durable and reliable construction.

An even further object of the present invention is to provide a new and improved weighted refuse container which is susceptible of a low cost of manufacture with regard to both materials and labor, and which accordingly is then susceptible of low prices of sale to the consuming public, thereby making such weighted refuse containers economically available to the buying public.

Still yet another object of the present invention is to provide a new and improved weighted refuse container which provides in the apparatuses and methods of the prior art some of the advantages thereof, while simultaneously overcoming some of the disadvantages normally associated therewith.

Still another object of the present invention is to provide a new and improved refuse container formed with a lid and a compartment within the lid and a container with a false floor to define a compartment to enable the weighting of the container lid and container with a respective measured quantity of water for biasing the container and lid against tippage by force of wind action and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
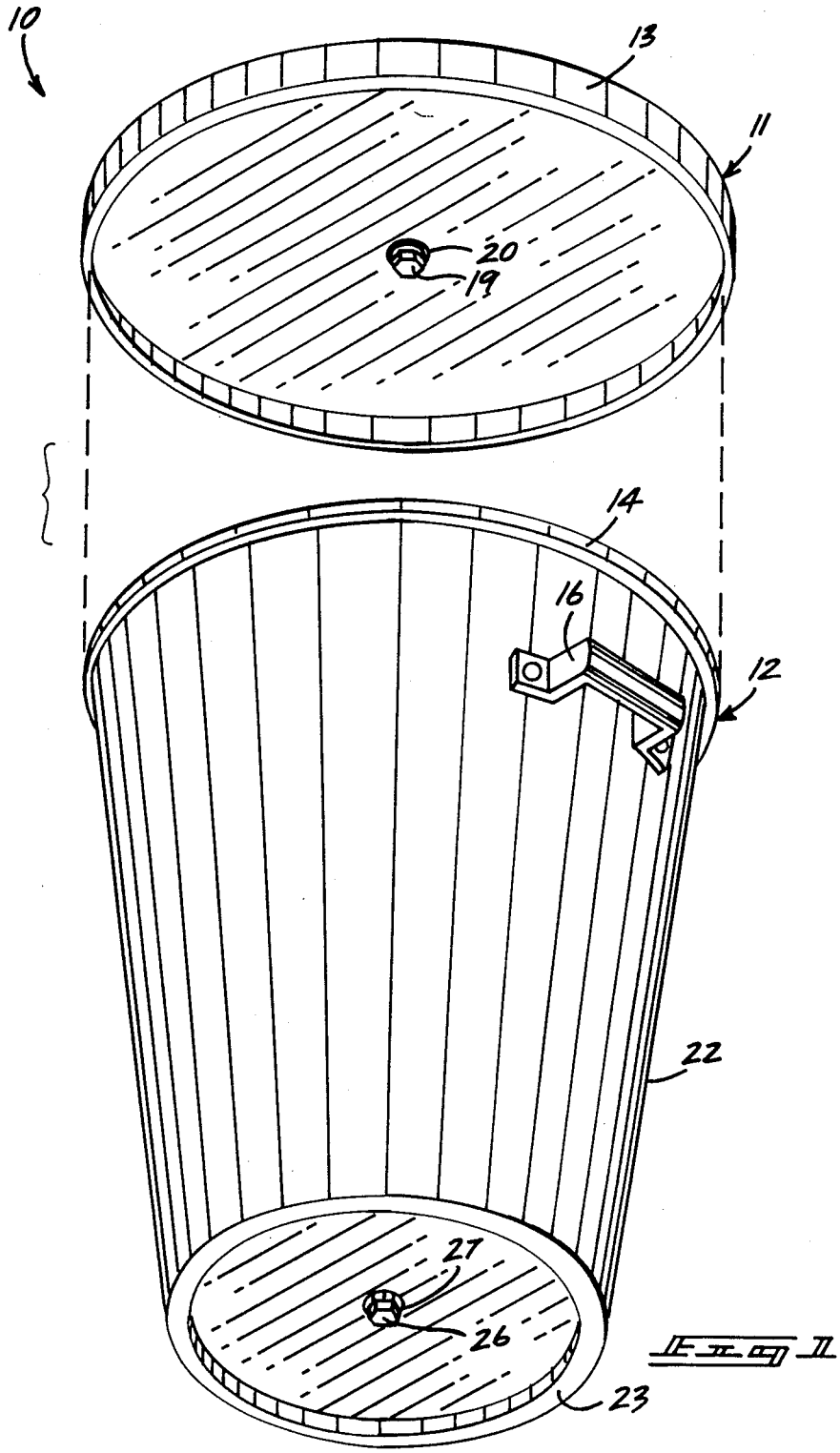
FIG. 1 is an isometric illustration of the instant invention.
Figure 2:
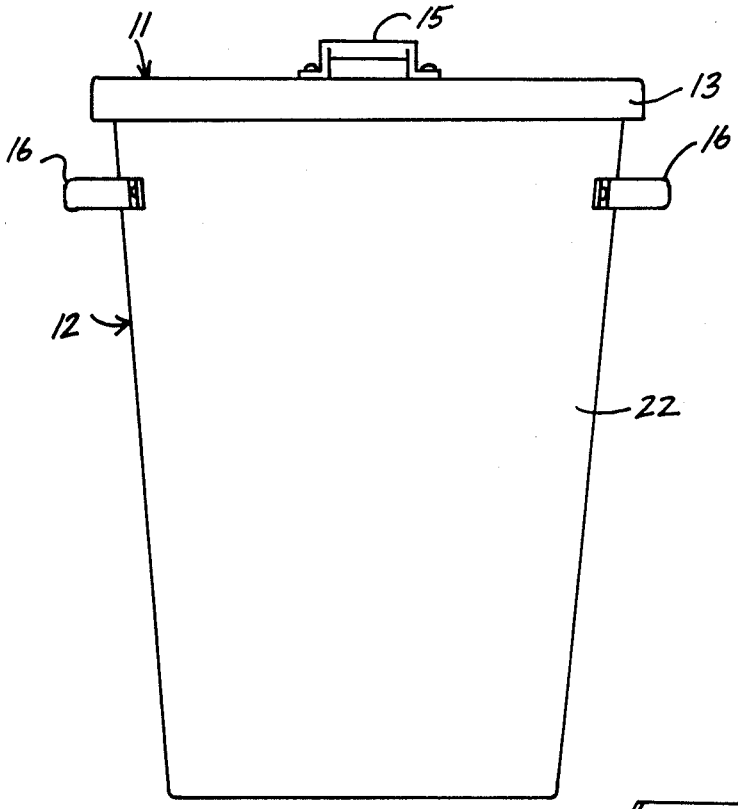
FIG. 2 is an orthographic view of the instant invention taken in elevation.
Figure 3:
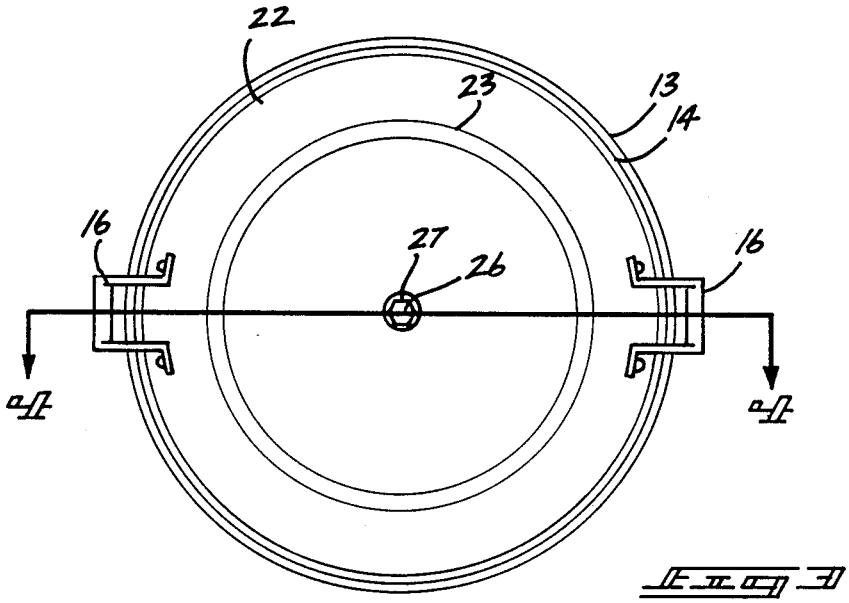
FIG. 3 is a bottom orthographic view of the instant invention.
Figure 4:
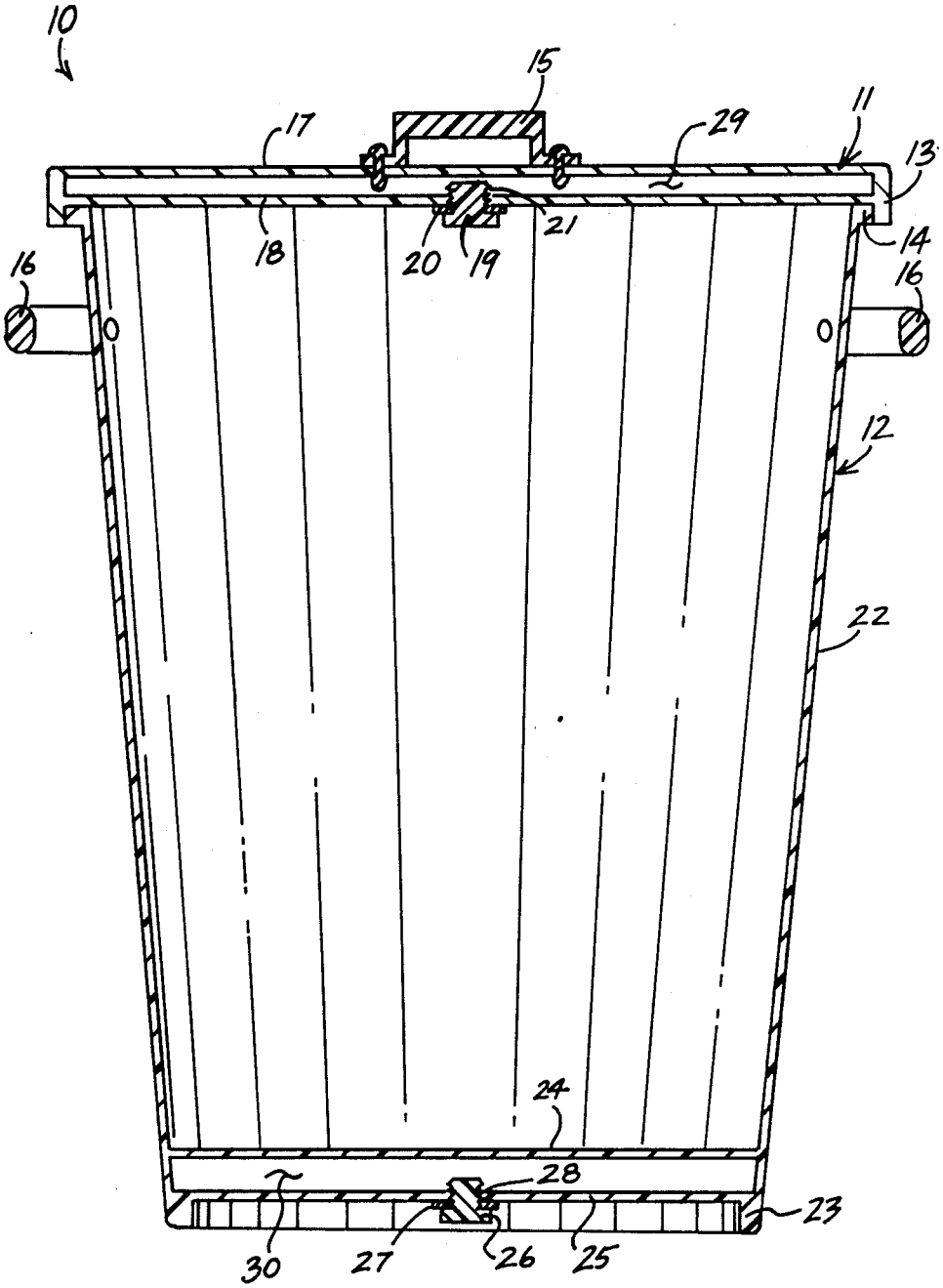
FIG. 4 is an orthographic view taken along the lines 4—4 of FIG. 3 in the direction indicated by the arrows

With reference now to the drawings, and in particular to FIGS. 1 to 4 thereof, a new and improved weighted refuse container embodying the principles and concepts of the present invention and generally designated by the reference numeral !0 will be described.

More specifically, it will be noted that the weighted refuse container !0 essentially comprises a lid 11 fixedly securable to a tapered receptacle 12 The lid and receptacle are formed of commercially available plastic-like materials of contemporary construction for light weight and ease of transport.

The lid 11 is formed with a downwardly depending perimeter flange 13 for cooperation with a radially projecting rim 14 integrally formed to an upper perimeter of the tapered wall 22 of receptacle 12. The rim 14 and flange 13 are preferably of an interference fit to secure the same together, wherein the inherent flexibility of the plastic-like materials utilized in construction of the container 10 enables selective removal of the lid from the receptacle.

The lid 11 is further formed with a roof 17 and a handle 15 centrally formed thereto by conventional connectors. Similarly, a plurality of diametrically spaced and opposed handles 16 are secured to an upper portion of the wall 22 of the receptacle 12.

The lid 11 includes a floor is formed in a relatively parallel relationship to the roof i? to create a lid chamber 29 therein. The floor 18 has centrally formed a threaded plug 19 with a sealing washer 20 wherein the plug 19 is threadedly engageable within complementary threads of a threaded lid bore 21.

The tapered wall 22 of the receptacle 12 terminates at a bottom edge with a lower flange 23 to space a second floor 25 above a support surface for the container 10. A first floor 24 is formed at a spaced distance above the second floor 25 to create a receptacle chamber 30. The second floor 25 is formed with a threaded receptacle bore 28 for receiving a second threaded plug 26 and a second sealing washer 27.

The receptacle chamber 80 is of a volume to receive approximately 5½ to 8 pints of water to provide an approximate weight in the range of 5 to 7 pounds. Comparably, the lid chamber 29 is of a volume to receive a lesser quantity of water and it has been established that a one pint capacity is sufficient to provide an approximate one pound weighted lid.

As to the manner of usage and operation of the present invention, the same should be apparent from the above description. Accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A refuse container comprising a receptacle means and a lid means for overlying securement to said receptacle means:

said receptacle means including a tapered continuous wall and floor with said wall terminating at a lower edge with a flange positioned below said floor, said floor defining a continuous web orthogonally and integrally joined to said wall, and a first floor disposed above said floor defining a second continuous web orthogonally and integrally joined to said wall, and said floor and said first floor defining a sealed water-tight receptacle chamber therebetween, and a removable plug means replaceably and sealingly securable to an opening in said floor for receiving fluid in said receptacle chamber, and said lid means includes a roof portion defining a lid roof web continuously and integrally joined to a downwardly depending flange wherein said flange is of a length and orientation terminating in a continuous downwardly depending edge for securement to an upper terminal end of said wall of said receptacle, and wherein said lid further includes a lid floor defining a lid floor web spaced below said lid roof web and above the lower continuous edge of said flange to define a lid chamber between said lid rood web and said lid floor web, and said lid floor web formed with a centrally positioned opening and a further plug removably and sealingly securable to said opening, and wherein said lid chamber is of a volume to receive a predetermined quantity of fluid, and said receptacle chamber is of a volume to receive a further quantity of fluid to exceed said predetermined quantity of fluid, and said continuous wall of said receptacle is downwardly tapering from an upper radially outwardly projecting rim for cooperation with said flange of said lid to said flange positioned below said floor, and wherein said plug in said floor sand said further plug in said lid are threadedly securable within complementary threaded openings respectively in said receptacle and said lid, and said openings are axially aligned.

* * * * *